US011583025B2

(12) United States Patent
Peace, III

(10) Patent No.: US 11,583,025 B2
(45) Date of Patent: Feb. 21, 2023

(54) HELMET STABILIZATION APPARATUS

(71) Applicant: Howard Donal Peace, III, Richmond, VA (US)

(72) Inventor: Howard Donal Peace, III, Richmond, VA (US)

( * ) Notice: Subject to any disclaimer, the term of this patent is extended or adjusted under 35 U.S.C. 154(b) by 281 days.

(21) Appl. No.: 16/805,082

(22) Filed: Feb. 28, 2020

(65) Prior Publication Data

US 2021/0267298 A1 Sep. 2, 2021

(51) Int. Cl.
*A42B 3/14* (2006.01)
*A42B 3/04* (2006.01)

(52) U.S. Cl.
CPC ..... *A42B 3/142* (2013.01); *A42B 3/0406* (2013.01)

(58) Field of Classification Search
CPC ..... A63B 71/10; A42B 3/0473
USPC ..... 2/425
See application file for complete search history.

(56) References Cited

U.S. PATENT DOCUMENTS

| | | | | |
|---|---|---|---|---|
| 3,873,996 | A * | 4/1975 | Varteressian | A42B 3/0473 2/421 |
| 5,371,905 | A * | 12/1994 | Keim | A42B 3/0473 2/413 |
| 6,006,368 | A * | 12/1999 | Phillips | A42B 3/0473 2/468 |
| 9,226,707 | B2 * | 1/2016 | Huang | A42B 3/0473 |
| 11,045,710 | B2 * | 6/2021 | Metts | A63B 71/12 |
| 2017/0150767 | A1 * | 6/2017 | Wetzel | A63B 71/10 |
| 2017/0188647 | A1 * | 7/2017 | Blecherman | A42B 1/08 |

* cited by examiner

*Primary Examiner* — Katherine M Moran
(74) *Attorney, Agent, or Firm* — Dunlap Bennett & Ludwig, PLLC

(57) ABSTRACT

A helmet stabilization system and apparatus for reducing the incidence of whiplash and neck injuries while wearing a helmet, such as in contact sports. The invention includes a helmet mount; a base mount configured for attachment to a shoulder harness; and a flex rod interconnectable between the helmet mount and the base mount. The flex rod, when interconnected between the helmet mount and the base mount provides a resistance to an extension or a compression sequence responsive to a contact imparted on the helmet. An oobleck may be provided in a coupling between the flex rod and the base mount to permit voluntary head movements of the user and to provide a resistance responsive to an impact force.

10 Claims, 3 Drawing Sheets

HELMET STABILIZATION APPARATUS

BACKGROUND OF THE INVENTION

The present invention relates to protective equipment for contact sports and, more particularly, for helmets in contact and helmeted sports.

In many contact sports, such as football, lacrosse, and hockey, players typically wear a protective helmet and shoulder pad assembly. While a helmet provides the athletes significant protection from impact injury, the increased weight of the helmet carried on the players can also contribute to the incidence of neck injuries with whiplash effects. Moreover, the increased circumferential dimensions of the helmet about the athlete's head provides an extended fulcrum upon which forces encountered during play of the contact sport may contribute to the incidence of neck injuries. These injuries can be exacerbated where the helmet is only retained to the athlete's head by a chinstrap with out stabilization.

As can be seen, there is a need for an improved helmet stabilization apparatus to reduce the incidence of injury in contact sports.

SUMMARY OF THE INVENTION

In one aspect of the present invention, a helmet stabilization apparatus is disclosed. The helmet stabilization apparatus includes a helmet mount configured for attachment to a posterior portion of a helmet shell. A base mount is configured for attachment to a shoulder harness worn about the shoulders of a user. A flex rod having a first end and a second end, is interconnectable between the helmet mount and the base mount. The flex rod, when interconnected between the helmet mount and the base mount provides a resistance to an extension or a compression sequence responsive to the contact imparted on the helmet.

In some embodiments, a protrusion extends from a first end of the flex rod. A keyed slot is defined in a surface of the helmet mount. The protrusion is dimensioned to be releasably retained within the keyed slot.

In some embodiments, a socketed coupling is provided between a second end of the flex rod and the base mount. The socketed coupling may include a ball disposed at the second end of the flex rod. A socket is configured to releasably receive the ball on the base mount.

In other embodiments, the socketed coupling includes an arcuate slot laterally disposed across the base mount.

In other embodiments, the socketed coupling includes a receiver defined in the base mount. A frictional interference fit is provided between the receiver and the second end of the flex rod, when the flex rod is carried in the receiver.

In yet other embodiments, the socketed coupling includes a quantity of an oobleck fluid carried within the socketed coupling. The oobleck fluid is formulated to permit movement of the flex rod in the socketed coupling responsive to a user's voluntary head movement and a substantially rigid connection responsive to an impact imparted on the helmet.

In other aspects of the invention, a helmet stabilization system is disclosed. The system includes a helmet mount attached to a posterior portion of the helmet. A base mount is attached to a shoulder harness worn about the shoulders of a user. A flex rod having a first end and a second end, is interconnectable between the helmet mount and the base mount. The flex rod provides a resistance to an extension or a compression sequence responsive to a contact imparted on the helmet. In some embodiments, the helmet is a football helmet, and the shoulder harness is a shoulder pad assembly.

In some embodiments, a protrusion extends from the first end of the flex rod. A keyed slot is defined in a surface of the helmet mount. The protrusion is dimensioned to be releasably retained within the keyed slot.

In other embodiments, the helmet stabilization system may include a socketed coupling between the second end of the flex rod and the base mount.

In yet other embodiments, a quantity of an oobleck fluid is carried within the socketed coupling. The oobleck fluid is selected to permit movement of the flex rod in the socketed coupling responsive to a user's voluntary head movement and a substantially rigid connection in response to an impact imparted on the helmet.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved helmet stabilization system to reduce the incidence of neck injuries while wearing a protective helmet.

Non-limiting embodiments of a helmet stabilization system is shown in reference to the drawings of FIGS. 1-6. For purposes of illustration and understanding of the invention, the helmet stabilization system is shown in the context of the sport of football, but may find applicability to other sports and endeavors in which a protective helmet is worn.

Figure 1:
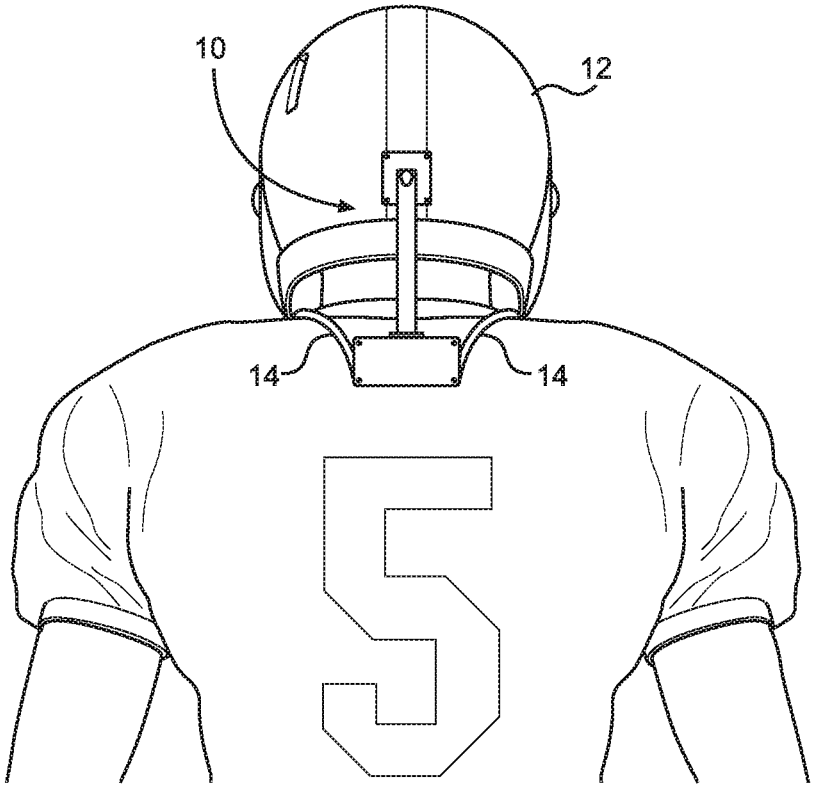
FIG. 1 is a Back View of the Flex Rod in Use Attached to a Football Helmet.
Figure 2:
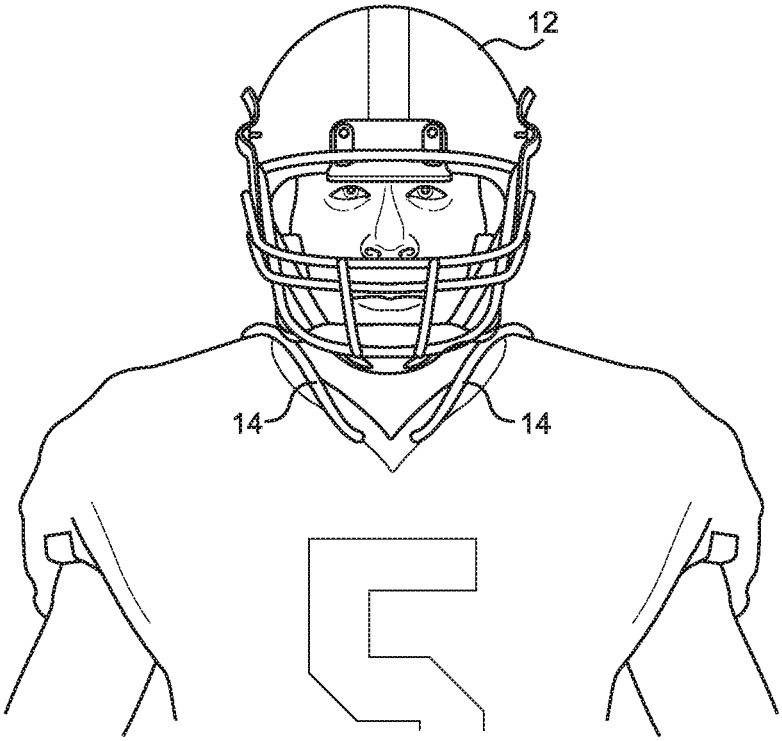
FIG. 2 is a Front View of the Flex Rod in Use Attached to a Football Helmet.
Figure 3:
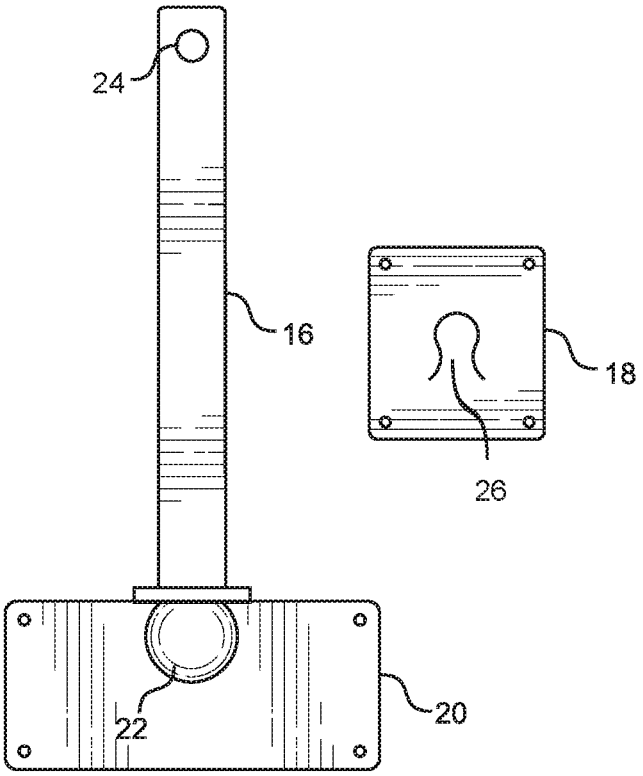
FIG. 3 is a View of the Flex Rod Utilizing a Ball and Socket Joint.
Figure 4:
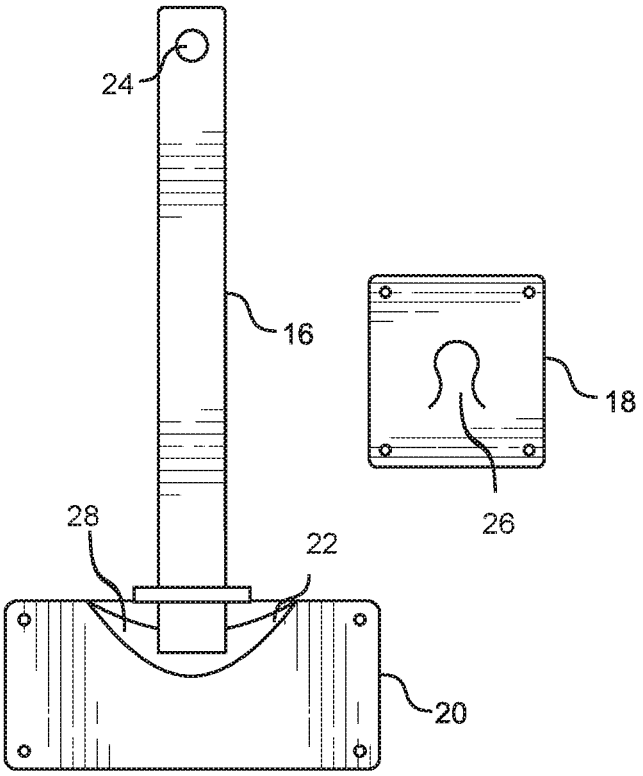
FIG. 4 is a View of an Alternate Embodiment of the Flex Rod.
Figure 5:
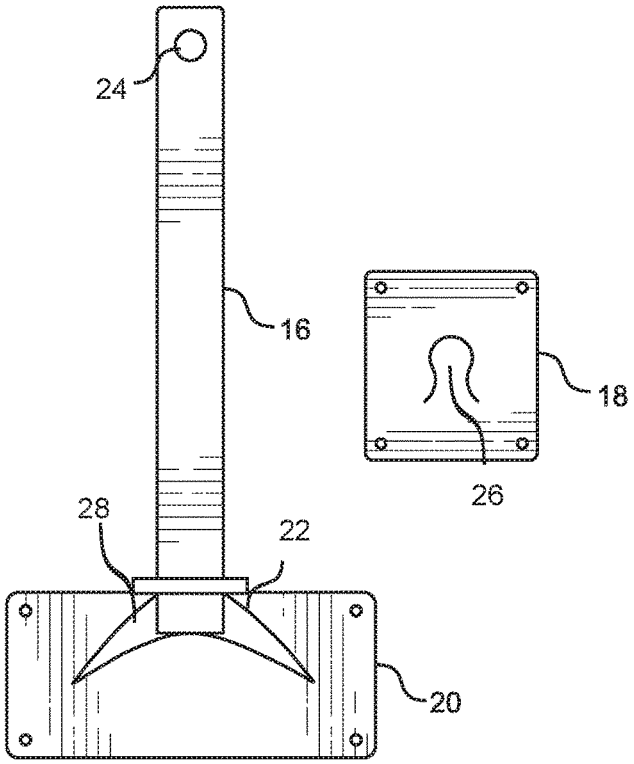
FIG. 5 is an Exploded View of the Flex Rod.
Figure 6:
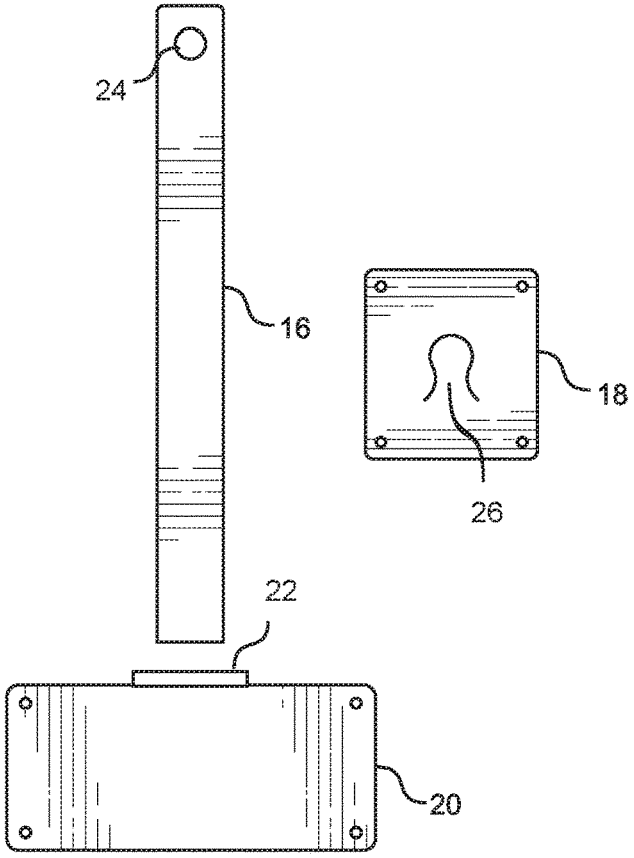
FIG. 6 is a View of an Alternate Embodiment of the Flex Rod.

As seen in reference to FIGS. 1 and 2, the helmet stabilization assembly 10 is configured to interconnect an aft portion of a protective helmet 12 to a harness 14 worn about the shoulders of the player. In the example of the football player shown in the drawings, the harness 14 would be a shoulder pad assembly worn by the athlete.

The helmet stabilization assembly 10 includes a flex rod 16 having a first end and a second end. The first end is coupled to a helmet mount 18 that is attachable to the protective helmet 12, by fasteners, such as rivets, bolts, screws, adhesives, or molding or weldment to a shell of the helmet 12. A second end of the flex rod 16 is releasably coupled to a base mount 20 that is attachable to the harness 14. At least one of the first end or the second end are releasably attached to their associated mount to facilitate removal of the helmet 12.

The helmet mount 18 and base mount 20 are attached in alignment along a sagittal plane of the wearer. The helmet mount 18 is preferably positioned at or above the junction of the spine with the cranium. The base mount 18 is preferably positioned between the shoulder blades and aligned with the spine of the wearer.

In the embodiments shown in reference to FIGS. 3-6, the first end of the flex rod 16 is connected to the helmet mount 14 via a protrusion 24 that is engageable with a keyed slot 26, where the protrusion 24 is retained by inwardly converging sidewalls of the keyed slot 26.

The second end of the flex rod 16 is coupled to the base mount 20 via a socketed coupling 22. The socketed coupling 22 may include a ball and socket, such as shown in reference to FIG. 3, a slotted socket, such as shown in reference to FIGS. 4 and 5, or a frictional socket, such as shown in reference to FIG. 6. Voluntary movements of the wearer's head, such as to look or turn in a different direction may be accommodated by the socketed coupling 22. In the socketed coupling 22 shown in FIG. 3, the user's voluntary movements may be somewhat limited. In the slotted configurations of FIGS. 4 and 5, the flex rod 16 is coupled within an arcuate slot 28 laterally disposed in the base mount 20. This configuration is preferable in applications where the wearer had a requirement to frequently look from side to side.

The flex rod 16 is configured to provide a resistance to an extension or a compression sequence depending on the direction of a contact imparted on the helmet 12. In the case of an anterior contact, the flex rod 16 would provide compressive resistance, through one or more of a compression of the flex rod 16 in a longitudinal axis of the flex rod 16 or a flexion of the flex rod 16 along a longitudinal length of the flex rod 16. In the case of a posterior contact, the flex rod 16 would provide an elastic resistance to movement of the helmet 12 in response to the contact. In the case of a lateral contact, the flex rod 16 may provide a resistance through one or more of a flexion or an elastic resistance of the flex rod 16.

The socketed coupling 22 may also include a quantity of an oobleck solution that permits movement of the flex rod 16 in the socketed coupling 22 in response to low velocity movements, such as the user's voluntary movements of their head. By contrast, the oobleck solution within the socketed coupling 22 provides a substantially rigid connection in response to high velocity impact imparted during a contact of the helmet 12, such as during game play for a contact sport, or an accident sequence which may be encountered in motor-sports events.

In some embodiments, the flex rod 16 may have an interior chamber that contains a volume of oobleck solution, such that during voluntary movements of the head, the flex rod remains elastic, while providing a rigid connection responsive to an impact force. The flex rod 16 and couplings 22 described herein may also have applicability in other applications where a variable response stabilization is useful, such as in structural supports for a building for earthquake response.

It should be understood, of course, that the foregoing relates to exemplary embodiments of the invention and that modifications may be made without departing from the spirit and scope of the invention as set forth in the following claims.

What is claimed is:

1. A helmet stabilization apparatus, comprising:

a helmet mount configured for attachment to a posterior portion of a helmet shell;

a base mount configured for attachment to a shoulder harness worn about the shoulders of a user;

a flex rod having a first end and a second end, the flex rod interconnectable between the helmet mount and the base mount, the flex rod, when interconnected between the helmet mount and the base mount providing a resistance to an extension or a compression sequence responsive to a contact imparted on the helmet;

a protrusion extending from a first end of the flex rod; and a keyed slot defined in a surface of the helmet mount, wherein the protrusion is dimensioned to be releasably retained within the keyed slot by an inwardly converging sidewall of the keyed slot.

2. The helmet stabilization apparatus of claim 1, further comprising:

a socketed coupling between a second end of the flex rod and the base mount.

3. The helmet stabilization apparatus of claim 2, wherein the socketed coupling comprises:

a ball disposed at the second end of the flex rod; and a socket configured to releasably receive the ball on the base mount.

4. The helmet stabilization apparatus of claim 2, wherein the socketed coupling comprises:

an arcuate slot laterally disposed across the base mount.

5. The helmet stabilization apparatus of claim 2, wherein the socketed coupling comprises:

a receiver defined in the base mount; and a frictional interference between the receiver and the second end of the flex rod, when carried in the receiver.

6. The helmet stabilization apparatus of claim 2, wherein the socketed coupling further comprises:

a quantity of an oobleck fluid carried within the socketed coupling, the oobleck fluid formulated to permit movement of the flex rod in the socketed coupling responsive to a user's voluntary head movement and a substantially rigid connection responsive to an impact imparted on the helmet.

7. A helmet stabilization system, comprising:

a helmet mount attached to a posterior portion of the helmet;

a base mount attached to a shoulder harness configured to be worn about the shoulders of a user;

a flex rod having a first end and a second end, the flex rod interconnectable between the helmet mount and the base mount, the flex rod configured to provide a resistance to an extension or a compression sequence responsive to a contact imparted on the helmet;

a protrusion extending from the first end of the flex rod; and a keyed slot defined in a surface of the helmet mount, wherein the protrusion is dimensioned to be releasably retained by an inwardly converging sidewall within the keyed slot.

8. The helmet stabilization system of claim 7, wherein the helmet is a football helmet, and the shoulder harness is a shoulder pad assembly.

9. The helmet stabilization system of claim 7, further comprising:

a socketed coupling between the second end of the flex rod and the base mount.

10. The helmet stabilization system of claim 9, wherein the socketed coupling further comprises:

a quantity of an oobleck fluid carried within the socketed coupling, the oobleck fluid selected to permit movement of the flex rod in the socketed coupling responsive to a user's voluntary head movement and a substantially rigid connection in response to an impact imparted on the helmet.

* * * * *